US006772841B2

(12) United States Patent
Gano

(10) Patent No.: US 6,772,841 B2
(45) Date of Patent: Aug. 10, 2004

(54) EXPANDABLE FLOAT SHOE AND ASSOCIATED METHODS

(75) Inventor: John C. Gano, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 42 days.

(21) Appl. No.: 10/121,471

(22) Filed: Apr. 11, 2002

(65) Prior Publication Data

US 2003/0192699 A1 Oct. 16, 2003

(51) Int. Cl.[7] ..... E21B 7/06; E21B 43/10

(52) U.S. Cl. ..... 166/313; 166/50; 166/117.6; 166/242.8

(58) Field of Search ..... 166/313, 50, 376, 166/242.8, 117.6, 117.5, 380

(56) References Cited

U.S. PATENT DOCUMENTS

| | | | | |
|---|---|---|---|---|
| 5,318,122 A | | 6/1994 | Murray et al. | |
| 5,330,007 A | | 7/1994 | Collins et al. | |
| 5,388,648 A | | 2/1995 | Jordan, Jr. | |
| 5,479,986 A | | 1/1996 | Gano et al. | |
| 5,655,602 A | | 8/1997 | Collins | |
| 5,695,008 A | | 12/1997 | Bertet et al. | |
| 5,718,288 A | | 2/1998 | Bertet et al. | |
| 5,964,288 A | * | 10/1999 | Leighton et al. | 166/207 |
| 5,979,560 A | | 11/1999 | Nobileau | |
| 6,026,903 A | | 2/2000 | Shy et al. | |
| 6,056,059 A | * | 5/2000 | Ohmer | 166/313 |
| 6,089,320 A | * | 7/2000 | LaGrange | 166/313 |
| 6,252,852 B1 | | 6/2001 | Rowles et al. | |
| 6,253,852 B1 | | 7/2001 | Nobileau | |
| 6,336,507 B1 | * | 1/2002 | Collins | 166/313 |
| 6,564,867 B2 | * | 5/2003 | Ohmer | 166/285 |
| 2002/0033261 A1 | * | 3/2002 | Metcalfe | 166/285 |

FOREIGN PATENT DOCUMENTS

| | | |
|---|---|---|
| GB | 2275286 A | 8/1994 |
| GB | 2353811 A | 3/2001 |
| WO | WO99/13195 | 3/1999 |
| WO | WO00/26501 A1 | 5/2000 |
| WO | WO 02/29207 A1 | 4/2002 |
| WO | WO 02/29208 A1 | 4/2002 |

OTHER PUBLICATIONS

Search Report For U.K. Application No. GB 0308353.2.

* cited by examiner

*Primary Examiner*—Hoang Dang
(74) *Attorney, Agent, or Firm*—Marlin R. Smith; J. Richard Konneker

(57) ABSTRACT

An expandable float shoe and associated methods are provided. In a described embodiment, an expandable float shoe is attached to a leg of an expandable wellbore junction. The float shoe and leg are radially compressed, such as by folding along their axial lengths. The wellbore junction is conveyed into a well and expanded by applying pressure therein. The float shoe expands outward, along with the leg of the wellbore junction.

65 Claims, 5 Drawing Sheets

EXPANDABLE FLOAT SHOE AND ASSOCIATED METHODS

BACKGROUND

The present invention relates generally to equipment utilized and operations performed in conjunction with a subterranean well and, in an embodiment described herein, more particularly provides an expandable float shoe and associated methods.

In a well in which intersecting wellbores are utilized, it is known to convey a wellbore junction into the well and position it at the desired wellbore intersection. In one method, the wellbore junction is conveyed into the well in a compressed shape, so that the wellbore junction may be displaced through casing above the wellbore intersection. The wellbore junction is then expanded at the wellbore intersection. This expansion provides enhanced access and flow through the junction.

Expansion of the wellbore junction may be accomplished by applying pressure internally to the junction, thereby inflating the junction. For example, one leg of the junction may be compressed and placed against the remainder of the junction, and then pressure applied internally to the leg causes it to move and expand outward. Unfortunately, such wellbore junction designs have met with limited success in satisfactorily expanding the junction leg.

In addition, a rigid closure is used to contain the pressure applied to the junction leg. This rigid closure increases the difficulty experienced in compressing the wellbore junction. Furthermore, the rigid closure is difficult to cut through when it is desired to provide access and flow through the leg after it is expanded.

From the foregoing, it can be seen that it would be quite desirable to provide an improved apparatus and method for expanding structures in a well.

SUMMARY

In carrying out the principles of the present invention, in accordance with an embodiment thereof, an expandable float shoe is provided which may be attached to a leg of a wellbore junction for use in expanding the junction. The float shoe utilizes a body and closure which are compressed with the junction leg, and which are designed to enhance the expansion operation and subsequent cutting through the float shoe to provide access and flow through the junction leg. Associated methods are also provided.

In one aspect of the invention, an expandable float shoe apparatus is provided. The apparatus includes a generally tubular body having first and second opposite ends, and a closure preventing flow through the body first end. The body and closure are formed into a compressed shape.

A force transmitting material may be contained within the float shoe body. The material may be disposed between the closure and a membrane. The membrane is exposed to the pressure applied to the wellbore junction, but prevents this pressure from being transmitted to the closure. The material transmits a force (produced by the pressure applied to the membrane) to the interior of the body, thereby causing the body to expand.

In another aspect of the invention, an expanding wellbore junction system is provided. The system includes a wellbore junction having at least one compressed leg, so that the wellbore junction is conveyable through a tubular string in a well, a generally tubular body attached to the leg, and a closure preventing flow through the body. Both the body and the closure are compressed. Pressure applied to an interior of the wellbore junction expands the leg, body and closure outward in the well.

In yet another aspect of the invention, a method of expanding a wellbore junction in a well is provided. The method includes the steps of attaching an expandable float shoe to a leg of the wellbore junction, compressing the float shoe and the leg, positioning the wellbore junction in the well, and expanding the float shoe and the leg in the well.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
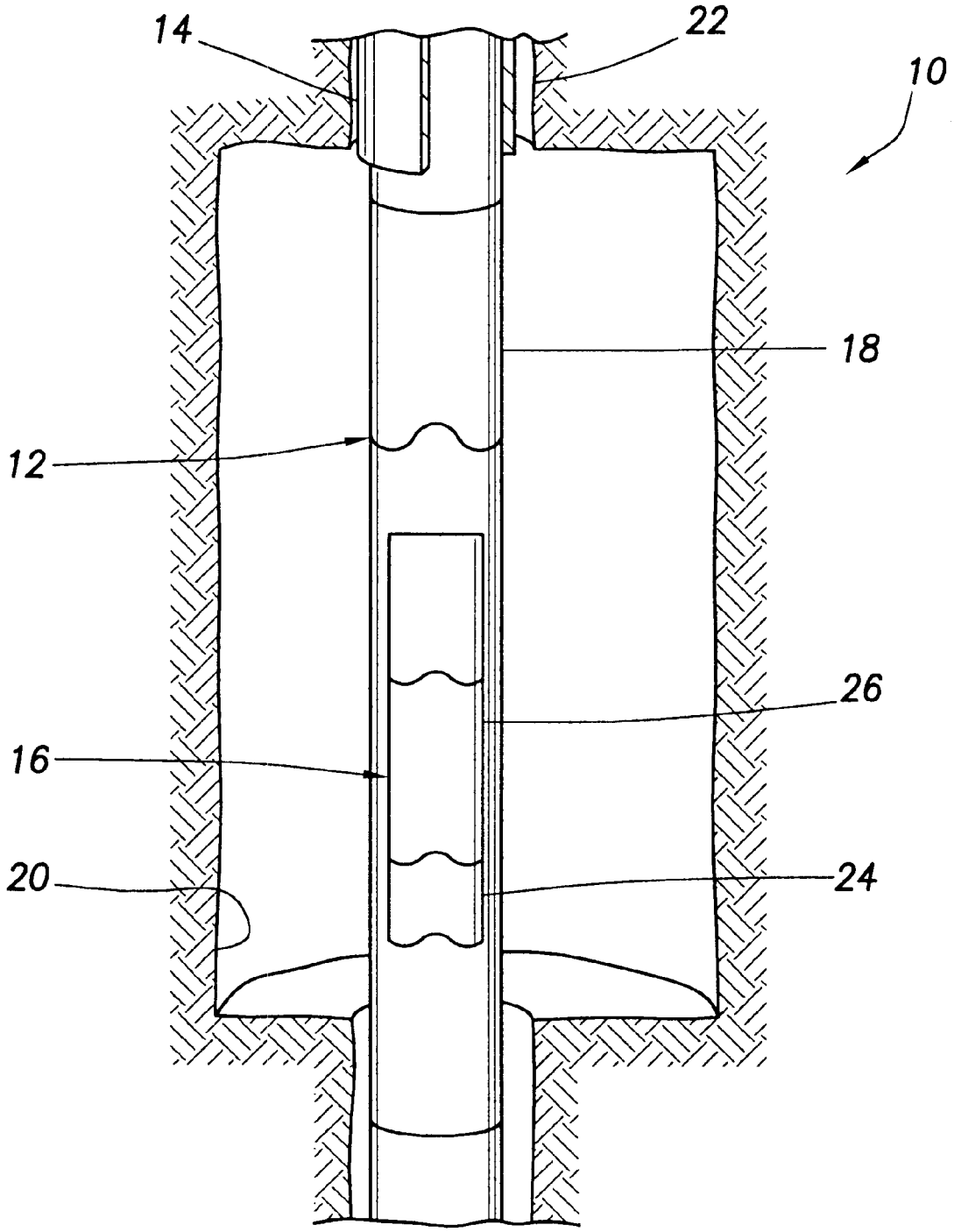
FIG. 1 is a partially cross-sectional view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, an expandable wellbore junction 12 is conveyed into a wellbore 22 through a casing or liner string 14. To permit the junction 12 to pass through the casing 14, the junction is formed into a compressed shape prior to conveying it into the well. As depicted in FIG. 1, a main tubular housing 18 of the junction 12 is folded somewhat along its length, and a tubular leg assembly 16 of the junction is also folded and positioned against the housing. It should be understood, however, that many different particular expanding apparatus configurations, methods of compressing the apparatus, etc. may be utilized without departing from the principles of the invention.

The compressed wellbore junction 12 is positioned within a radially enlarged cavity 20 formed in the well. The cavity 20 is formed at a location where it is desired to drill another wellbore (not shown) extending outwardly therefrom. To drill the intersecting wellbore, the wellbore junction 12 is expanded so that cutting tools, such as mills and drills, may pass therethrough. In particular, the leg assembly 16 is expanded in the method 10 so that the cutting tools are permitted to pass therethrough to drill the intersecting wellbore.

Figure 2:
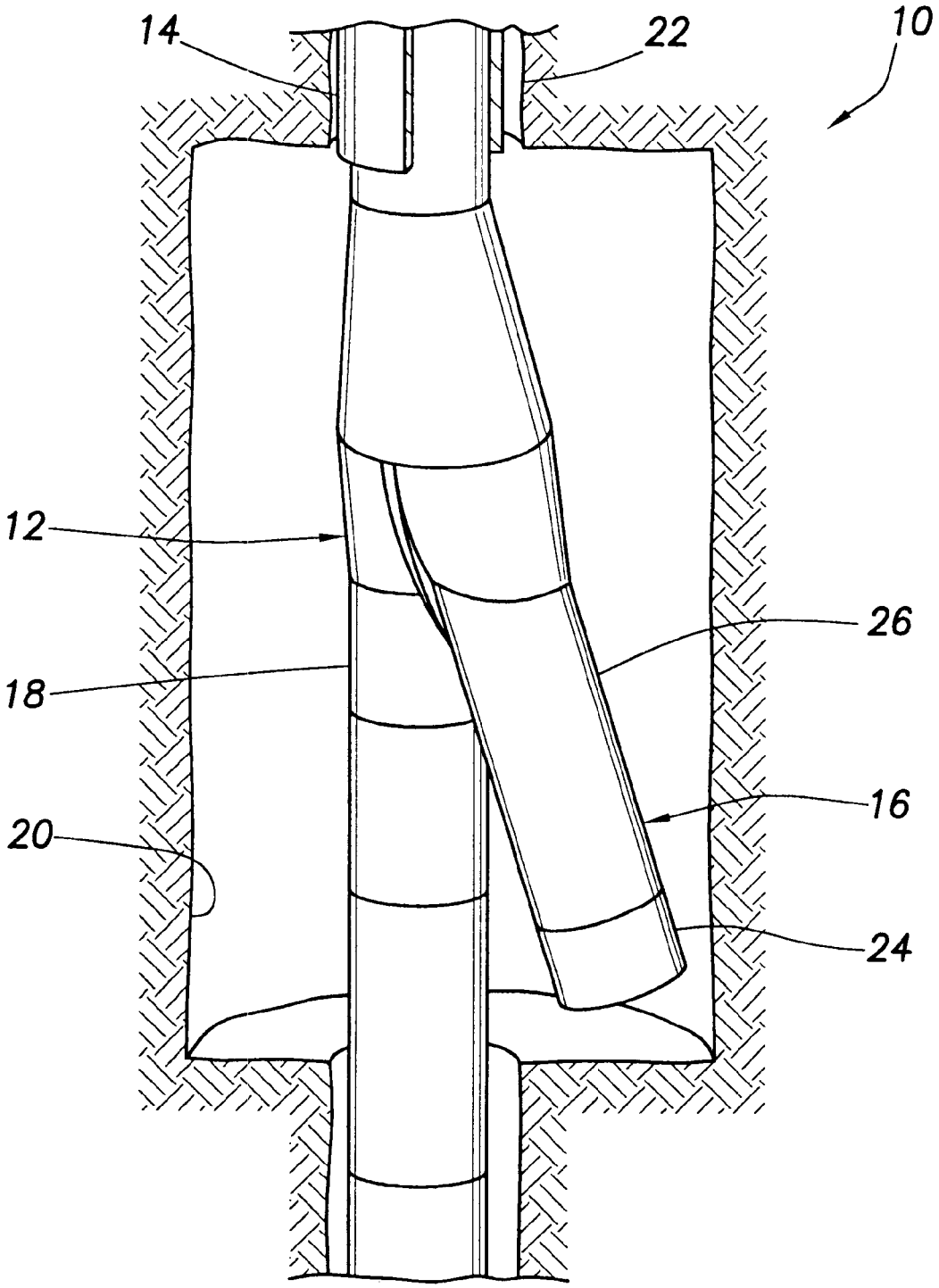
FIG. 2 is a partially cross-sectional view of the method of FIG. 1, wherein a wellbore junction has been expanded in a well.

Referring additionally now to FIG. 2, the method 10 is representatively illustrated wherein the wellbore junction 12 has been expanded within the cavity 20. Note that both the junction housing 18 and the leg assembly 16 have been expanded radially outward so that they assume their pre-compressed cylindrical shapes. This expansion of the wellbore junction 12 is performed by applying pressure to the interior of the junction and inflating the previously compressed portions of the junction.

To contain the pressure applied to inflate the junction 12, the leg assembly 16 includes a float shoe 24 attached to an outer end of a tubular leg 26 of the assembly. Note that the float shoe 24 is expanded outward along with the leg 26. The float shoe 24 is designed to both seal the end of the leg 26 to prevent escape of the inflation pressure from the leg, and to permit compression and expansion of the float shoe along with the leg. In addition, the float shoe 24 is also designed to permit ease of cutting therethrough when it is desired to drill the intersecting wellbore.

After expanding the wellbore junction 12, the junction is preferably cemented within the cavity 20. After the cement has hardened, the intersecting wellbore is drilled by passing cutting tools through the leg 26. Of course, other techniques may be used to form intersecting wellbores in a well. For example, it is not necessary for the cavity 20 to be formed if the wellbore 22 is sufficiently large to accommodate the expanded wellbore junction 12. As another example, the intersecting wellbore may be already formed prior to conveying the wellbore junction 12 into the well. Therefore, it will be readily appreciated that the principles of the invention are not limited to the specific details of the method 10 described herein.

Figure 3:
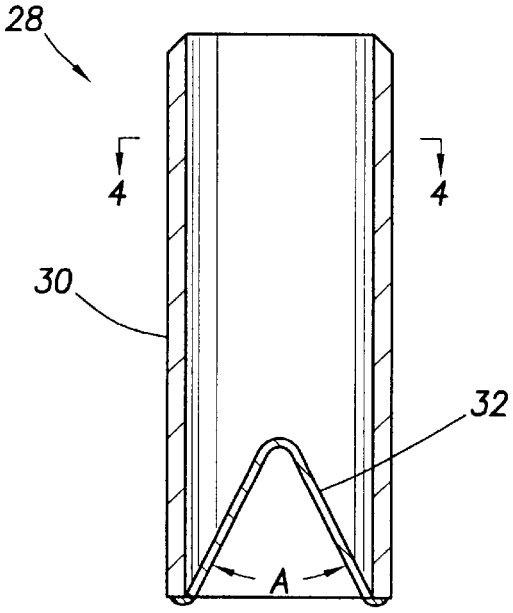
FIG. 3 is a cross-sectional view of a float shoe which may be used in the method of FIG. 1, the float shoe embodying principles of the invention.

Referring additionally now to FIG. 3, a float shoe 28 is representatively illustrated. The float shoe 28 may be used for the float shoe 24 in the method 10 described above, or the float shoe 28 may be used in other methods.

As depicted in FIG. 3, the float shoe 28 includes a tubular body 30 and a closure 32. The closure 32 is preferably welded to the lower end of the body 30 and seals against fluid pressure transmission therethrough. Other attachment and sealing means (e.g., threads and seals, such as o-rings) may be used in keeping with the principles of the invention.

The closure 32 has a generally conical shape and is relatively thin as compared to the body 30, so that the closure is readily folded or otherwise compressed. The closure 32 is preferably made of a metal material, such as steel, but other materials may be used if desired.

The conical shape of the closure 32 preferably has an interior included angle A of less than about 60°. It is expected that this conical shape will satisfactorily resist forces applied thereto, for example, during expansion and compression of the leg assembly 16. Another benefit of the conical shape of the closure 32 is that it is relatively easy to cut through, reducing the possibility that a flat "spinner" or other obstruction to cutting will be formed when the closure is cut through.

Yet another benefit of the conical shape is that it is relatively easily folded along with the body 30 along an axial length of the body. A further benefit of the conical shape is that it satisfactorily resists forces applied to it from above, that is, from within the body 30. However, it should be understood that the closure 32 could have other shapes in keeping with the principles of the invention.

Figure 4:
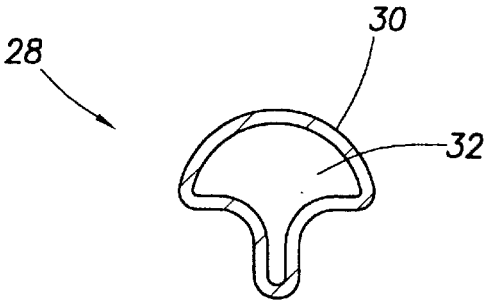
FIG. 4 is a cross-sectional view of the float shoe of FIG. 3, the float shoe being in a compressed configuration.

Referring additionally now to FIG. 4, a cross-sectional view of the body 30 is depicted after the body has been folded along its axis. This compressed shape permits the float shoe 28 to be positioned alongside the housing 18, which has preferably been folded into a complementary compressed shape.

To expand the float shoe 28, fluid pressure is applied to the interior of the body 30. In the method 10, this occurs as pressure is applied internally to the wellbore junction 12. The float shoe 28 expands outward along with the leg 26. The closure 32 may then be removed by cutting through it.

Figure 5:
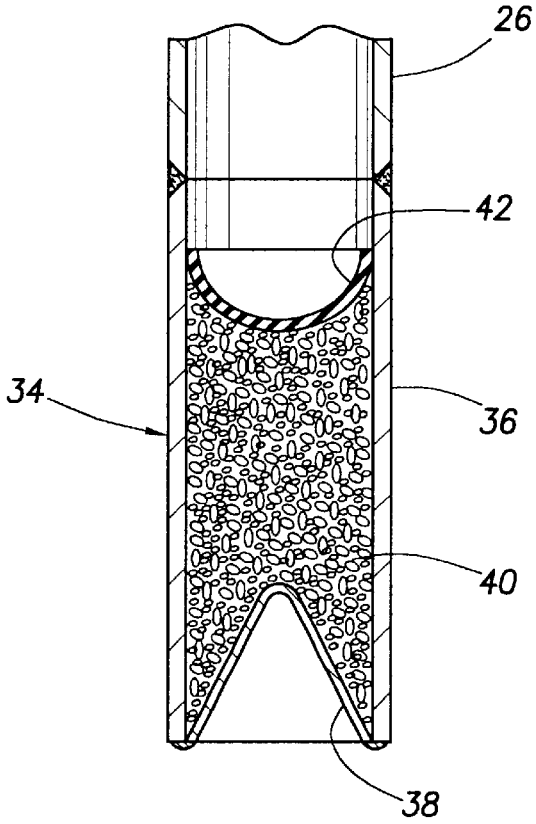
FIG. 5 is a cross-sectional view of another float shoe embodying principles of the invention.

Referring additionally now to FIG. 5, another float shoe 34 is representatively illustrated. The float shoe 34 may be used for the float shoe 24 in the method 10. Of course, the float shoe 34 may be used in other methods in keeping with the principles of the invention.

The float shoe 34 is similar in some respects to the float shoe 28 described above, in that it includes a tubular body 36 and a closure 38 similar to the body 30 and closure 32 of the float shoe 28. It should be understood, however, that the float shoe 34 could include differently configured bodies and/or closures, without departing from the principles of the invention.

The float shoe 34 is depicted in FIG. 5 sealingly attached to the lower end of the leg 26. Preferably this attachment is performed by welding the leg 26 to the body 36 prior to compressing the leg and float shoe 34. Other sealing and attaching means may be used in keeping with the principles of the invention.

The float shoe 34 further includes a force transmitting material 40 contained within the body 36. The material 40 is preferably contained between the closure 38 and a flexible membrane 42 within the body 36. The material 40 is used to transmit a force generated by the inflation pressure acting on the membrane 42 to the interior of the body 36 between the membrane and the closure 38. The material 40 may, for example, be aggregate or a granular material, such as sand, or proppant, etc.

The membrane 42 is preferably made of a flexible material, such as an elastomer. The membrane 42 is preferably sealingly attached to the interior of the body 36 by, for example, adhering a perimeter of the membrane to the interior of the body. Other sealing and attaching means may be used in keeping with the principles of the invention.

As depicted in FIG. 5, the membrane 42 has a hollow semi-spherical shape with a concave side facing upward, and a convex side facing downward and in contact with the material 40. Note that the closure 38 also has a convex side facing toward the membrane 42 and in contact with the material 40. A concave side of the closure 38 faces downward.

In one construction of the float shoe 34, the material 40 is at substantially atmospheric pressure when the float shoe is conveyed into a well. Both the membrane 42 and the closure 38 are sealed to the body 36, and so well pressure cannot enter the interior of the body about the material 40. However, since the membrane 42 can displace in response to the pressure differential thereacross, the material 40 is compressed somewhat between the membrane and the closure 38 in the body 36 when the float shoe 34 is exposed to well pressure. Due to friction between individual particles or grains, etc. of the material 40, the material outwardly supports the membrane 42, closure 38 and body 36 of the float shoe 34 when well pressure is applied thereto.

Figure 6:
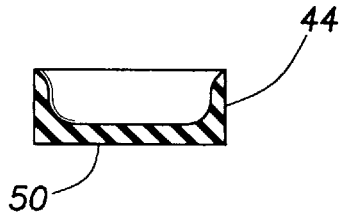
FIGS. 6–9 are cross-sectional views of membranes which may be used in the float shoe of FIG. 5.
Figure 7:
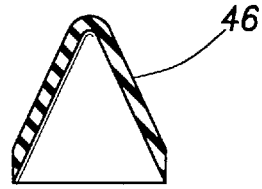

In FIGS. 6–9 are representatively illustrated several alternate embodiments of membranes 44, 46, 48 which may be used in place of the membrane 42 in the float shoe 34. The membrane 44 depicted in FIG. 6 is made of an elastomer and has a generally flat portion 50 which extends across the interior of the body 36. The membrane 46 depicted in FIG. 7 is made of an elastomer and has a generally conical shape, similar to the closure 38. The membrane 46 is shown with its convex side facing upward to indicate that it may be installed in the body 36 in this orientation, so that the concave side of the membrane faces the convex side of the closure 38.

Figure 8:
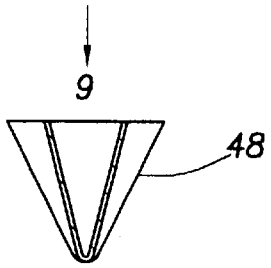
Figure 9:
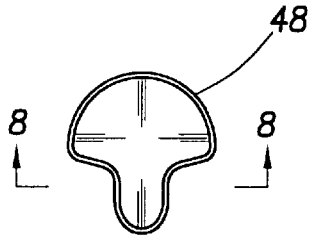

The membrane 48 shown in FIGS. 8 & 9 is made of a metal, such as steel, and is depicted in its compressed configuration in which it is folded along its axial length. The closure 38 would have a similar compressed shape. In fact, the closure 38 and membrane 48 may be essentially identical, except that preferably the membrane is sufficiently flexible to elongate downward when the pressure is applied thereto to inflate the wellbore junction 12.

It will, thus, be readily appreciated that the membrane 42 may have any suitable shape and may be made of any suitable material, without departing from the principles of the invention.

The force transmitting material 40 is used to transmit force to the interior of the body 36 to expand the body outward. The material 40 may include substantially spherical members, such as beads of the type used for proppant in formation fracturing operations. The material 40 may include granular members, such as sand or gravel of the type used in gravel packing operations.

Relatively smooth, hard, spherical members in the material 40 will have comparatively low friction and will transmit the force not only to the interior of the body 36, but also to the closure 38. Since the closure 38 is preferably made in a relatively thin and easily compressed configuration, it is desired to prevent excessive force from being transmitted to the closure from the membrane 42 through the material 40. Reduction of the force transmitted to the closure 38 may be accomplished by adding relatively irregular, such as granular, members to the material 40 to increase the friction therein. Therefore, it will be readily appreciated that the amount of force transmitted to the closure 38 may be regulated by adjusting the friction in the material 40, for example, by changing the types and relative quantities of various members in the material.

It may now be fully appreciated that the membrane 42 isolates the closure 38 from fluid pressure applied internally to the leg 26, while the material 40 transmits the force due to the pressure on the membrane to the interior of the body 36. The material 40 also prevents the force from being transmitted excessively to the closure 38, which could damage the closure. The material 40 further outwardly supports the body 36, membrane 42 and closure 38 against well pressure, as described above.

As the body 36 expands outward, its internal volume increases. To compensate for this increased volume, the membrane 42 preferably elongates by stretching downward. Note that other methods may be used to compensate for the increased volume in the expanded body 36 in keeping with the principles of the invention, for example, by providing a piston in place of the membrane 42, the piston displacing downward as the body expands, etc.

Figure 10:
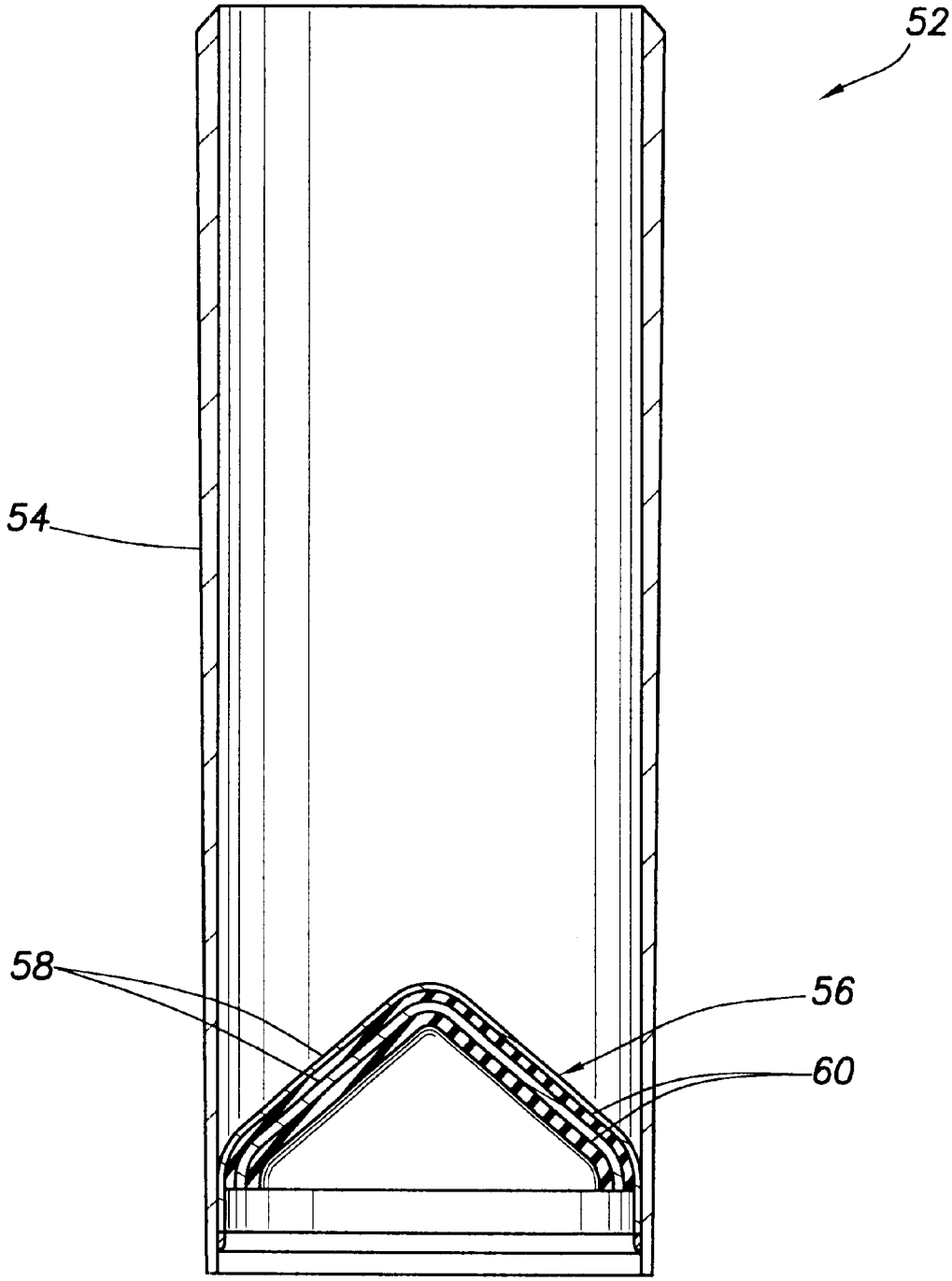
FIG. 10 is a cross-sectional view of another float shoe embodying principles of the invention.

Referring additionally now to FIG. 10, another float shoe 52 is representatively illustrated. The float shoe 52 may be used for the float shoe 24 in the method 10. Of course, the float shoe 52 may be used in other methods in keeping with the principles of the invention.

The float shoe 52 includes a tubular body 54 which is tapered along its axial length. The wall thickness of the body 54 decreases progressively from its upper end to its lower end. Specifically, the outer diameter of the body 54 decreases from the body upper end to its lower end. The wall thickness could alternatively, or additionally, be decreased by increasing the inner diameter of the body 54 near its lower end.

Note that the tapered, progressively decreasing wall thickness of the body 54 is not necessary, since other means may be used to enhance expansion of the body. For example, a different, or at least more flexible, material may be used in the body 54 lower end. As another example, changes in the body 54 wall thickness could be accomplished in discreet steps, instead of progressively.

The tapered body 54 provides enhanced expansion of the float shoe 52 when the wellbore junction 12 is inflated. It will be readily appreciated that the lower end of the body will expand more readily since it has a reduced wall thickness. The tapered body 54 could be used advantageously in place of the body 36 in the float shoe 34 depicted in FIG. 5, since friction in the material 40 will decrease the force transmitted to the interior of the body progressively from the membrane 42 to the closure 38.

The float shoe 52 depicted in FIG. 10 also includes a closure 56, which is configured so that it has enhanced strength and flexibility, while being relatively easily compressed. The closure 56 includes multiple layers 58 of a relatively high strength material, such as steel, and multiple layers 60 of a relatively flexible material, such as an elastomer. Preferably, these layers 58, 60 are alternated as depicted in FIG. 10.

An outer one of the layers 58 is sealingly attached to the body 54 along a perimeter of the layer, such as by welding. For this purpose, the outer layer 58 attached to the body 54 may be thicker than the rest of the layers 58. This increased thickness of the outer layer 58 will also aid in resisting axial shear applied to the closure 56, for example, when pressure is applied thereto, or a force is transmitted thereto. Other sealing and attaching means may be used in keeping with the principles of the invention.

Figure 11:
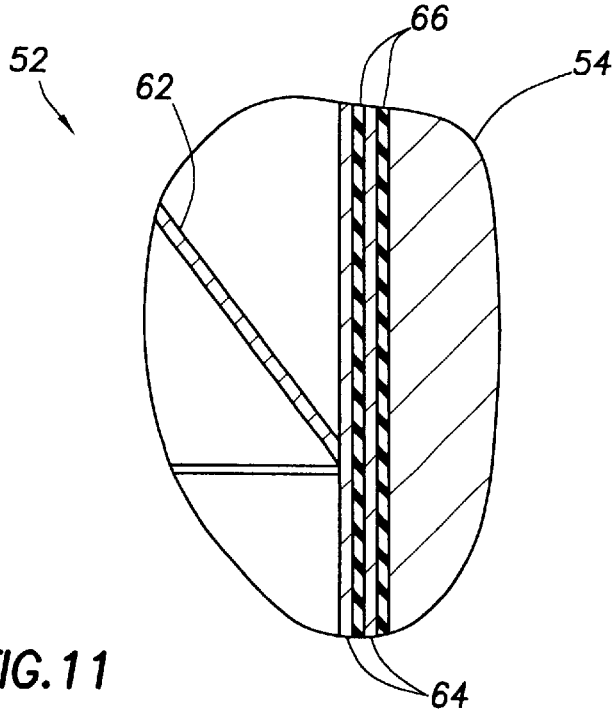
FIG. 11 is a cross-sectional view of an alternate construction of the float shoe of FIG. 10.

Referring additionally now to FIG. 11, an alternate construction of the float shoe 52 is representatively illustrated. Instead of the closure 56 made up of multiple layers 58, 60, the float shoe 52 depicted in FIG. 11 includes a single layer thickness closure 62, which is attached to an inner one of multiple relatively high strength layers 64 on the interior of the body 54. The layers 64 are preferably alternated with multiple relatively flexible layers 66.

The relatively high strength layers 64 are used to resist axial shear forces applied thereto, for example, due to pressure applied to the closure 62, or a force being transmitted thereto. The flexible layers 66 are used to permit some movement between the layers 64 due to axial shear, while transmitting the radially directed inflation pressure or force to the interior surface of the body 54. The layered construction, including the relatively thin wall thickness layers 64, 66, is easily compressed, expanded and cut through in the method 10 described above.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. An expandable float shoe apparatus, comprising:

a generally tubular body having first and second opposite ends;

a closure preventing flow through the body first end; and a force transmitting material contained within the body and isolated from fluid in the body, wherein the body and closure are formed into a compressed shape.

2. The apparatus according to claim 1, wherein the body and closure are folded together in the compressed shape.

3. The apparatus according to claim 1, wherein the material transmits a force radially outward to an interior surface of the body, thereby expanding the body.

4. The apparatus according to claim 3, wherein the material transmits the force axially to the closure.

5. The apparatus according to claim 1, wherein the material outwardly supports the body against pressure applied externally to the apparatus.

6. The apparatus according to claim 1, wherein the body is attached to an expandable wellbore junction.

7. An expandable float shoe apparatus, comprising:

a generally tubular body having first and second opposite ends;

a closure preventing flow through the body first end; and a force transmitting material contained within the body, wherein the body and closure are formed into a compressed shape, and wherein the material includes substantially spherical members.

8. An expandable float shoe apparatus, comprising:

a generally tubular body having first and second opposite ends;

a closure preventing flow through the body first end; and a force transmitting material contained within the body, wherein the body and closure are formed into a compressed shape, and wherein the material includes substantially granular members.

9. An expandable float shoe apparatus, comprising:

a generally tubular body having first and second opposite ends;

a closure preventing flow through the body first end; and a force material contained within the body, wherein the body and closure are formed into a compressed shape, and wherein the material is further contained between the closure and a membrane.

10. The apparatus according to claim 9, wherein the membrane prevents fluid pressure transmission through the body second end.

11. The apparatus according to claim 9, wherein the body and membrane are folded together in the compressed shape.

12. The apparatus according to claim 9, wherein the material is compressed between the closure and the membrane when pressure is applied to the membrane.

13. The apparatus according to claim 9, wherein the material outwardly supports the closure and the membrane when pressure is applied to the membrane.

14. The apparatus according to claim 9, wherein the membrane has a generally hollow semi-spherical shape.

15. The apparatus according to claim 9, wherein the membrane has a generally hollow conical shape.

16. The apparatus according to claim 9, wherein each of the membrane and the closure has opposing concave and convex sides.

17. The apparatus according to claim 16, wherein the membrane and closure convex sides face toward each other.

18. The apparatus according to claim 16, wherein the closure convex side faces toward the membrane concave side.

19. An expandable float shoe apparatus, comprising:

a generally tubular body having first and second opposite ends; and a closure preventing flow through the body first end, wherein the body and closure are formed into a compressed shape, and wherein the closure has a generally hollow conical shape.

20. An expandable float shoe apparatus, comprising:

a generally tubular body having first and second opposite ends; and a closure preventing flow through the body first end, wherein the body and closure are formed into a compressed shape, and wherein the closure includes multiple layers.

21. The apparatus according to claim 20, wherein the layers include alternating layers of metal and non-metal materials.

22. The apparatus according to claim 20, wherein the layers include at least one relatively easily deformed layer and at least one relatively rigid layer.

23. The apparatus according to claim 22 wherein multiple relatively easily deformed layers are alternated with multiple relatively rigid layers.

24. An expandable float shoe apparatus, comprising:

a generally tubular body having first and second opposite ends; and a closure preventing flow through the body first end, wherein the body and closure are formed into a compressed shape, and wherein the body further includes a portion having multiple layers, the closure being attached to the body at the multiple layer portion.

25. The apparatus according to claim 24, wherein the layers include alternating layers of metal and non-metal materials.

26. The apparatus according to claim 24, wherein the layers include at least one relatively easily deformed layer and at least one relatively rigid layer.

27. The apparatus according to claim 26, wherein multiple relatively easily deformed layers are alternated with multiple relatively rigid layers.

28. An expandable float shoe apparatus, comprising:

a generally tubular body having first and second opposite ends; and a closure preventing flow through the body first end, wherein the body and closure are formed into a compressed shape, and wherein the body is tapered, a thinner portion of the body expanding more readily than a thicker portion of the body.

29. An expandable float shoe apparatus, comprising:

a generally tubular body having first and second opposite ends; and a closure preventing flow through the body first end, wherein the body and closure are formed into a compressed shape, wherein the body has a wall thickness, and wherein the wall thickness increases from the first end to the second end.

30. An expanding wellbore junction system, comprising:

a wellbore junction having at least one compressed leg, so that the wellbore junction is conveyable through a tubular string in a well;

a generally tubular body attached to the leg, the body being compressed;

a closure preventing flow through the body, the closure being compressed, whereby pressure applied to an interior of the wellbore junction expands the leg, body and closure outward in the wall; and a force transmitting material contained within the body and isolated from fluid in the body.

31. The system according to claim 30, wherein the material transmits a force radially outward to an interior surface of the body, thereby expanding the body.

32. The system according to claim 31, wherein the material transmits the force axially to the closure.

33. An expanding wellbore junction system, comprising:

a wellbore junction having at least one compressed leg, so that the wellbore junction is conveyable through a tubular string in a well;

a generally tubular body attached to the leg, the body being compressed;

a closure preventing flow through the body, the closure being compressed, whereby pressure applied to an interior of the wellbore junction expands the leg, body and closure outward in the well; and a force transmitting material contained within the body, wherein the material includes substantially spherical members.

34. An expanding wellbore junction system, comprising:

a wellbore junction having at least one compressed leg, so that the wellbore junction is conveyable through a tubular string in a well;

a generally tubular body attached to the leg, the body being compressed;

a closure preventing flow through the body, the closure being compressed, whereby pressure applied to an interior of the wellbore junction expands the leg, body and closure outward in the well; and a force transmitting material contained within the body, wherein the material includes substantially granular members.

35. An expanding wellbore junction system, comprising:

a wellbore junction having at least one compressed leg, so that the wellbore junction is conveyable through a tubular string in a well;

a generally tubular body attached to the leg, the body being compressed;

a closure preventing flow through the body, the closure being compressed, whereby pressure applied to an interior of the wellbore junction expands the leg, body and closure outward in the well; and a force transmitting material contained within the body, wherein the material is further contained between the closure and a membrane.

36. The system according to claim 35, wherein the membrane prevents fluid pressure transmission through the body.

37. The system according to claim 35, wherein the body and membrane are folded together.

38. The system according to claim 35, wherein the material is compressed between the closure and the membrane when pressure is applied to the membrane.

39. The system according to claim 35, wherein the membrane has a generally hollow semi-spherical shape.

40. The system according to claim 35, wherein the membrane has a generally hollow conical shape.

41. The system according to claim 35, wherein each of the membrane and the closure has opposing concave and convex sides.

42. The system according to claim 41, wherein the membrane and closure convex sides face toward each other.

43. The system according to claim 41, wherein the closure convex side faces toward the membrane concave side.

44. An expanding wellbore junction system, comprising:

a wellbore junction having at least one compressed leg, so that the wellbore junction is conveyable through a tubular string in a well;

a generally tubular body attached to the leg, the body being compressed; and a closure preventing flow through the body, the closure being compressed, whereby pressure applied to an interior of the wellbore junction expands the leg, body and closure outward in the well, wherein the closure has a generally hollow conical shape.

45. An expanding wellbore junction system, comprising:

a wellbore junction having at least one compressed leg, so that the wellbore junction is conveyable through a tubular string in a well;

a generally tubular body attached to the leg, the body being compressed; and a closure preventing flow through the body, the closure being compressed, whereby pressure applied to an interior of the wellbore junction expands the leg, body and closure outward in the well, wherein the closure includes multiple layers.

46. The system according to claim 45, wherein the layers include alternating layers of metal and non-metal materials.

47. The system according to claim 45, wherein the layers include at least one relatively easily deformed layer and at least one relatively rigid layer.

48. The system according to claim 47, wherein multiple relatively easily deformed layers are alternated with multiple relatively rigid layers.

49. An expanding wellbore junction system, comprising:

a wellbore junction having at least one compressed leg, so that the wellbore junction is conveyable through a tubular string in a well;

a generally tubular body attached to the leg, the body being compressed; and a closure preventing flow through the body, the closure being compressed, whereby pressure applied to an interior of the wellbore junction expands the leg, body and closure outward in the well, wherein the body further includes a portion having multiple layers, the closure being attached to the body at the multiple layer portion.

50. The system according to claim 49, wherein the layers include alternating layers of metal and non-metal materials.

51. The system according to claim 49, wherein the layers include at least one relatively easily deformed layer and at least one relatively rigid layer.

52. The system according to claim 51, wherein multiple relatively easily deformed layers are alternated with multiple relatively rigid layers.

53. An expanding wellbore junction system, comprising:

a wellbore junction having at least one compressed leg, so that the wellbore junction is conveyable through a tubular string in a well;

a generally tubular body attached to the leg, the body being compressed; and a closure preventing flow through the body, the closure being compressed, whereby pressure applied to an interior of the wellbore junction expands the leg, body and closure outward in the well, wherein the body is tapered, a thinner portion of the body expanding more readily than a thicker portion of the body.

54. An expanding wellbore junction system, comprising:

a wellbore junction having at least one compressed leg, so that the wellbore junction is conveyable through a tubular string in a well;

a generally tubular body attached to the leg, the body being compressed; and a closure preventing flow through the body, the closure being compressed, whereby pressure applied to an interior of the wellbore junction expands the leg, body and closure outward in the well, wherein the body has a wall thickness, and wherein the wall thickness increases from the first end to the second end.

55. A method of expanding a wellbore junction in a well, the method comprising the steps of:

attaching an expandable float shoe to a leg of the wellbore junction, the float shoe having a body;

compressing the float shoe and the leg;

positioning the wellbore junction in the well; and expanding the float shoe and the leg in the well, the compressing step further comprising compressing a membrane within the body.

56. The method according to claim 55, wherein the attaching step is performed prior to the compressing step.

57. The method according to claim 55, wherein the expanding step further comprises applying pressure internally to the wellbore junction, thereby inflating the leg and float shoe.

58. The method according to claim 55, wherein the compressing step further comprises radially compressing the leg and float shoe.

59. The method according to claim 55, wherein the compressing step further comprises folding the leg and float shoe along axial lengths thereof.

60. The method according to claim 55, wherein the body is generally tubular, and the compressing step further comprises compressing a closure in the body of the float shoe.

61. A method of expanding a wellbore junction in a well, the method comprising the steps of:

attaching an expandable float shoe to a leg of the wellbore junction;

compressing the float shoe and the leg;

positioning the wellbore junction in the well; and expanding the float shoe and the leg in the well, wherein the expanding step further comprises applying pressure to a membrane in the float shoe, thereby transmitting force to a material contained in the float shoe.

62. The method according to claim 61, wherein the material is contained between the membrane and a closure of the float shoe in the expanding step.

63. The method according to claim 62, wherein the closure is isolated from pressure applied to the membrane in the expanding step.

64. The method according to claim 61, wherein the material transmits force from the membrane to an interior of the float shoe in the expanding step.

65. The method according to claim 61, wherein the membrane elongates axially within a generally tubular body of the float shoe, thereby forcing the material radially outward to expand the body, in the expanding step.

* * * * *